United States Patent [19]

Fischer

[11] Patent Number: 5,033,559

[45] Date of Patent: Jul. 23, 1991

[54] DRILL BIT WITH FACETED PROFILE

[75] Inventor: John G. Fischer, Irving, Tex.

[73] Assignee: Dresser Industries, Inc., Dallas, Tex.

[21] Appl. No.: 523,802

[22] Filed: May 15, 1990

Related U.S. Application Data

[63] Continuation-in-part of Ser. No. 523,235, May 11, 1990, abandoned.

[51] Int. Cl.[5] ..... E21B 10/46; B22C 7/00; B22C 9/22; B22D 21/06

[52] U.S. Cl. ..... 175/329; 76/108.2; 76/108.4; 164/9; 164/17; 164/44; 164/45; 175/410; 419/18

[58] Field of Search ..... 175/410, 329, 409, 411, 175/412, 413, 379, 374, 375, 376, 377, 397, 398; 76/108.4, 108.2, 108.6, 108.1, DIG. 11, DIG. 12; 419/1, 18; 164/6, 9, 15, 17, 44, 45

[56] References Cited

U.S. PATENT DOCUMENTS

| | | | |
|---|---|---|---|
| Re. 32,036 | 11/1985 | Dennis | 175/329 |
| 4,244,432 | 1/1981 | Rowley et al. | 175/329 |
| 4,246,977 | 1/1981 | Allen | 175/410 X |
| 4,397,361 | 8/1983 | Langford, Jr. | 175/329 |
| 4,429,755 | 2/1984 | Williamson | 175/329 |
| 4,475,606 | 10/1984 | Crow | 175/410 |
| 4,499,795 | 2/1985 | Radtke | 76/108 A |
| 4,630,692 | 12/1986 | Ecer | 175/410 X |
| 4,640,375 | 2/1987 | Barr et al. | 175/410 |
| 4,676,124 | 6/1987 | Fischer | 76/108 A |
| 4,694,919 | 9/1987 | Barr | 175/393 |
| 4,753,305 | 6/1988 | Fisher | 175/410 |
| 4,780,274 | 10/1988 | Barr | 419/7 |
| 4,947,945 | 8/1990 | Griffin | 175/410 X |

*Primary Examiner*—Stephen J. Novosad

[57] ABSTRACT

A drag bit with a faceted profile and method of its manufacture by which the facets provide for planar mold surfaces upon which cores having planar ends can completely contact the surface of the mold. The invention is particularly though not exclusively adapted to matrix body drag bits incorporating PDC cutters having tungsten carbide studs or cylinders which are mounted in wings, ribs or blades of the bit body. In accordance with a preferred embodiment of the present invention, the wings, ribs or blades have a small planar surface or facet at each PDC cutter location with each of the facets being at a consistent angular disposition with respect to the axis of the corresponding cutter stud. The facets are created by flat mold surfaces which facilitate the proper positioning and angular disposition of the cores which form the openings in the matrix for receiving the PDC cutters. In the practice of the present invention, the facets or flats are formed in a hard mold during machining or in a soft mold by using a bit pattern having corresponding facets.

27 Claims, 2 Drawing Sheets

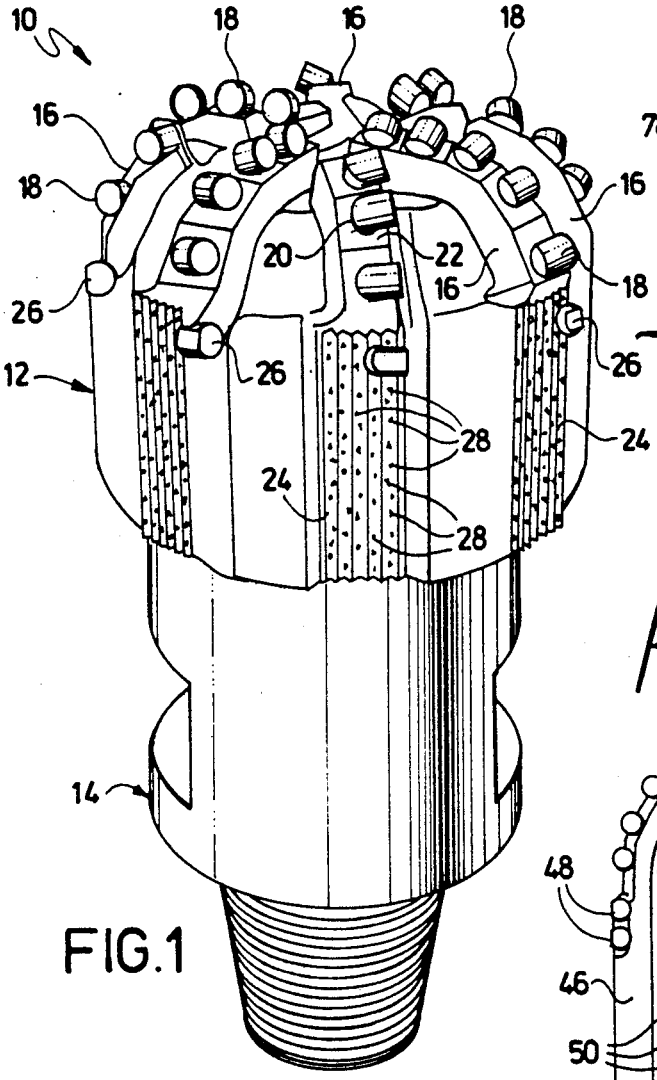
FIG.1
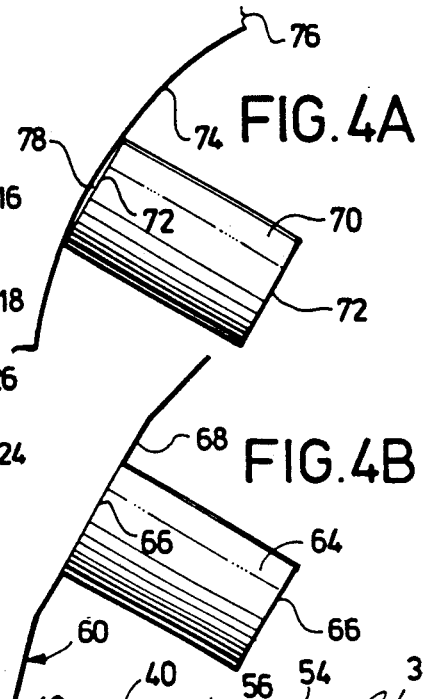
FIG.4A
FIG.4B
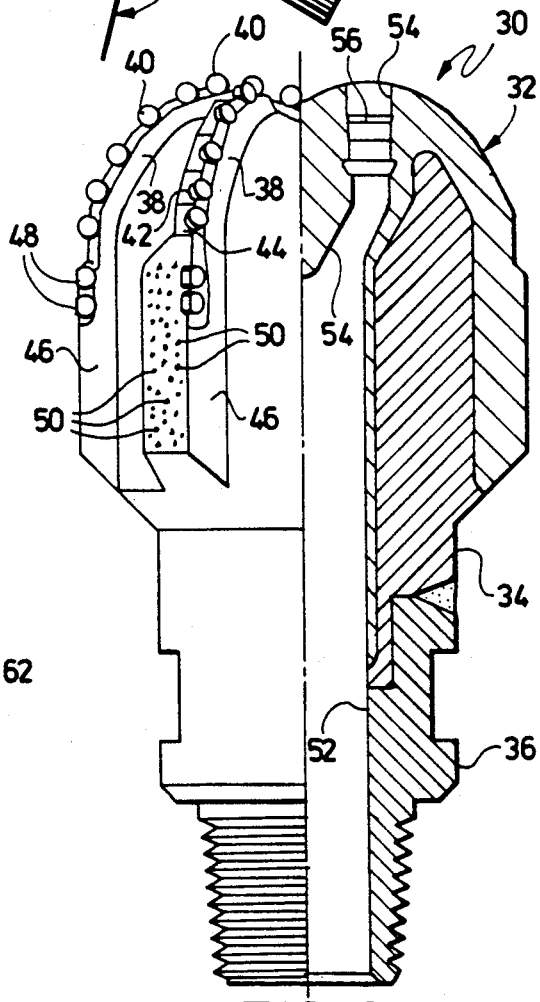
FIG. 2
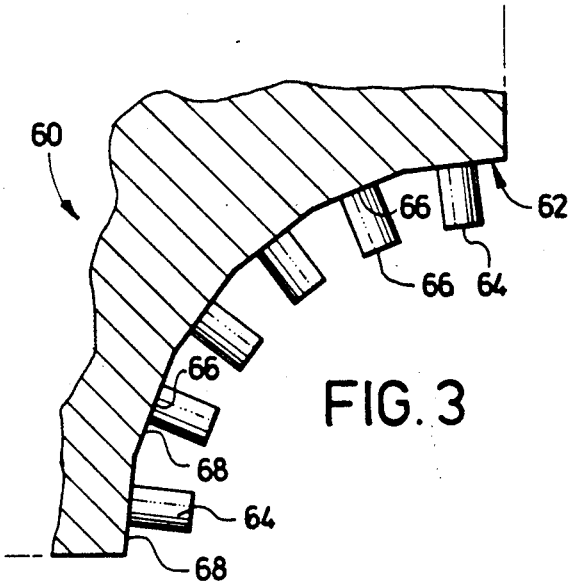
FIG. 3

DRILL BIT WITH FACETED PROFILE

CROSS-REFERENCE TO RELATED APPLICATIONS

This application is a continuation-in-part of application Ser. No. 07/523,235, filed on May 11, 1990, now abandoned.

BACKGROUND OF THE INVENTION

This invention relates to earth boring drill bits and, more particularly, it concerns an improved drag bit having a faceted profile.

Typically, earth boring drill bits and particularly those commonly known as drag bits have cutting surfaces made up of a number of polycrystalline diamond compact (PDC) cutters such as STRATAPAX TM cutting elements from General Electric Company. Each of the PDC cutters is normally mounted on a tungsten carbide stud or cylinder which is received within a corresponding aperture in the drill bit body during bit fabrication. Conventional PDC drag bits such as STRAT-X® bits produced by Security Division, Dresser Industries, Inc., Dallas, Tex., have either a steel or a matrix bit body and come in a variety of bit profiles, such as, blade, conical, frustrum, concave or stepped, for use in differing drilling conditions and for penetrating different types of formations.

The drill bit design and manufacturing industry has made a significant effort to distribute the individual cutters about the drill bit to provide the most efficient operation. In particular, a variety of methods and techniques have been developed so as to produce a cutter distribution which provides for uniform cutter wear in order to maximize the service life of the drill bit. However, cutter distributions developed, for example, by a computer program are often difficult to implement given existing bit fabrication techniques.

Accurate placement of stud mounted PDC cutters during steel body bit manufacture is relatively easy in that each of the stud receiving cylindrical openings in the steel bit body is drilled separately. On the other hand, accurate placement of PDC cutters during matrix body bit manufacture is more difficult using conventional molding processes. This is especially true in producing matrix body bits having curved profiles. As such, the most efficient matrix body drag bit designs will not be realized until the PDC cutters are accurately positioned during bit fabrication.

Generally, matrix body PDC drag bits are produced by adhering a hard metal matrix to a steel head blank using an infiltration process, securing a number of PDC cutters to the bit body by brazing each of the cutter support studs or cylinders into a corresponding opening in the matrix body, and, then, securing a pin section or top sub to the head blank by, for example, arc welding. Typically, the infiltration process is a casting technique in which a porous skeleton, such as tungsten carbide or another hard metal powder, is filled by a liquid binder alloy, such as a copper alloy, having a lower melting temperature than the skeleton. The infiltration process requires the use of a bit mold to conform the porous powder skeleton to the desired bit profile during infiltration.

Bit mold making requires considerable expertise and involves precision work. Hard molds which are machined from graphite give excellent reproduction. Soft molds which are pressed from bit patterns are better suited for reproducing bits with complex geometries and provide the best bit-to-bit reproduction.

Since a matrix bit body is very hard and somewhat brittle and, as such, extremely difficult to machine, the openings in the matrix body adapted to receive the support studs or cylinders of the PDC cutters cannot be drilled separately as is done with steel body bits. Instead, these openings are formed by placing cores or plugs in the bit mold prior to the addition of the hard metal powder skeleton. These cores or plugs are formed from a material, such as graphite, which is easily removed following the infiltration process.

Usually, these cores or plugs have planar ends which do not conform to the curved inner surfaces of the bit mold. This mismatch between the planar ends of the cores and the curved inner surface of the mold leads to inexact placement and angular orientation of the cores which in turn leads to inaccurate location and angular disposition of the PDC cutters.

Moreover, this geometric incongruity between the cores and the curved mold surface allows the hard powdered metal skeleton and alloy material to leak between the core and mold, and, thereby form an undesirable sprue or flash of hard powdered metal or matrix material in the resultant opening in the matrix bit body. Removal of this sprue or flash of hard powdered metal and matrix material is very difficult and time consuming clean-up work which requires the use of expensive tooling and which adds to the cost of bit production.

In light of the foregoing, there is a need for an improved drag bit design and method which facilitates accurate cutter placement and simplifies bit manufacturing.

SUMMARY OF THE INVENTION

In accordance with the present invention, the problems associated with conventional drag bit designs of the type described are addressed by a drag bit with a faceted profile and method of its manufacture by which the facets provide for planar mold surfaces upon which cores or plugs having planar ends can completely contact the surface of the mold.

The invention is particularly though not exclusively adapted to matrix body drag bits incorporating PDC cutters having tungsten carbide studs which are mounted in wings, ribs or blades of the bit body. In accordance with a preferred embodiment of the present invention, the wings, ribs or blades have a small planar surface or facet at each PDC cutter location. The facets are created by flat mold surfaces which facilitate the accurate positioning and angular disposition of the cores or plugs which form the openings in the matrix for receiving the PDC cutters. In the practice of the present invention, the facets or flats are formed in a hard mold during machining or in a soft mold by using a bit pattern having corresponding facets.

Accordingly, a principal object of the present invention is to provide an improved drag bit design and method incorporating a faceted profile which facilitates accurate cutter location and angular orientation and which reduces clean-up time and tooling costs. Another and more specific object of the invention is the provision of a matrix body drag bit mold having a faceted inner surface which makes provision for attaching cores or plugs having planar ends. Yet another and more specific object of the present invention is to provide a bit pattern having a faceted profile for forming a soft mold having a corresponding faceted inner surface. Still yet another object of the present invention is to provide a full bore drag bit which is more effective and yet less expensive to produce than conventional bits. Other objects and further scope of applicability of the present invention will become apparent from the detailed description to follow taken in conjunction with the accompanying drawings in which like parts are designated by like reference characters.

BRIEF DESCRIPTION OF THE DRAWINGS

FIG. 1 is a perspective view illustrating an exemplary embodiment of a drag bit having faceted wings in accordance with the present invention;

FIG. 2 is a partial side view and vertical cross section of another exemplary embodiment of a matrix body drag bit in accordance with the present invention;

FIG. 3 is a schematic vertical cross section of a matrix body bit mold having a faceted inner surface in accordance with the present invention;

FIG. 4A is an enlarged side view illustration of a core attached to a conventional curved mold surface;

FIG. 4B is a similar enlarged side view representing a core attached to a flat in a mold surface in accordance with the present invention.

DETAILED DESCRIPTION OF THE PREFERRED EMBODIMENTS

Figure 5A:
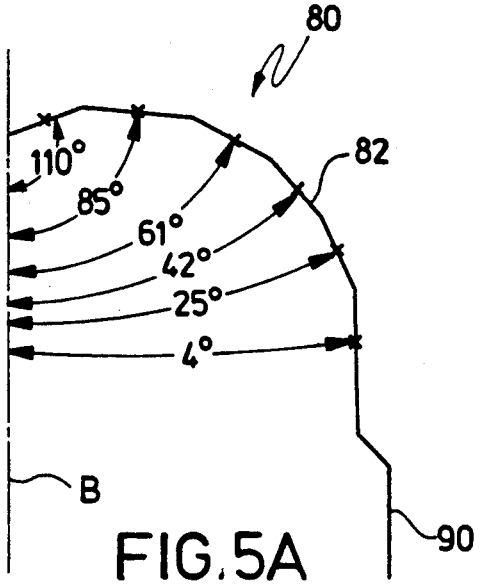
FIGS. 5A-5D are cross section illustrations of the 0°, 90°, 180° and 270° wings of an exemplary bit pattern in accordance with the present invention.

In FIG. 1 of the drawings, an exemplary embodiment of a drag bit of the present invention is generally designated by the reference numeral 10 and shown to include a frustrum profile bit body 12 connected to a threaded API pin section or top sub 14 which is adapted for connection with the lower end of a conventional drill string or rod.

In accordance with the present invention, the bit body 12 includes a plurality of faceted wings 16 each of which supports a plurality of round top PDC face cutters 18. Each of the PDC cutters 18 is mounted in a corresponding aperture 20 in a separate facet or flat 22 in the faceted wings 16. The bit body 12 further includes a plurality of gage pads 24 which may support one or more flat top PDC gage trimmers 26 and natural diamonds 28.

As shown in FIG. 2 of the drawings, another exemplary embodiment of a drag bit of the present invention is generally designated by the reference numeral 30 and shown to include a matrix bit body 32 having a profile which is conical with a concave center, a steel head blank 34, and an API pin section or top sub 36.

In accordance with the present invention, the matrix bit body 32 includes a plurality of faceted wings 38 each of which supports a plurality of round top PDC face cutters 40. Each of the PDC cutters 40 is mounted in a respective aperture 42 in a small planar surface or facet 44 of the faceted wings 38. The matrix bit body 32 further includes a plurality of gage pads 46 which may have one or more flat top gage trimmers 48 and natural diamonds 50.

It is preferred that each of the PDC cutters 18 and 40 of the drag bits 10 and 30 are carbide post or stud mounted PDC cutters. As such, the respective cutter supporting apertures 20 and 42 in the drag bits 10 and 30 are substantially cylindrical and sized to receive the carbide studs of the PDC cutters 18 and 40.

With reference again to FIG. 2 of the drawings, the matrix body drag bit 30 includes a central passage 52 ending in a plurality of fluid circulation ports 54 each of which supports an interchangeable nozzle 56. The passage 52, ports 54, and nozzles 56 provide for a selected flow of drilling fluid between the faceted wings 38 and gage pads 46 for removing cuttings from the borehole bottom and for cooling the PDC cutters 40.

Although not shown in FIG. 1 of the drawings, it is to be understood that the drag bit 10 also includes a central fluid passage, a plurality of fluid ports, and interchangeable nozzles to provide for a selected flow of drilling fluid between the wings 16 and gage pads 24 for removing cuttings from the borehole bottom and for cooling the PDC cutters 18.

Figure 5B:
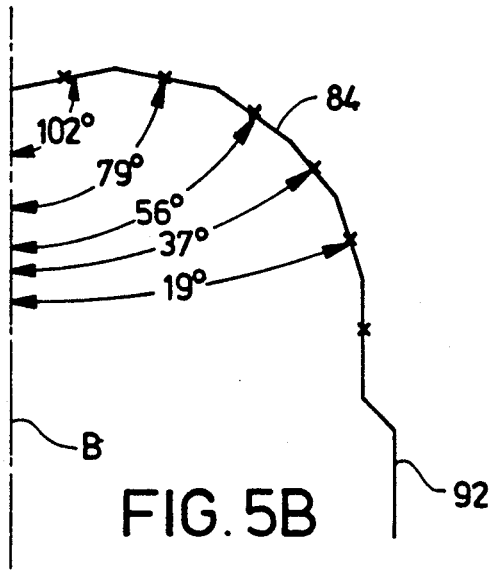
Figure 5C:
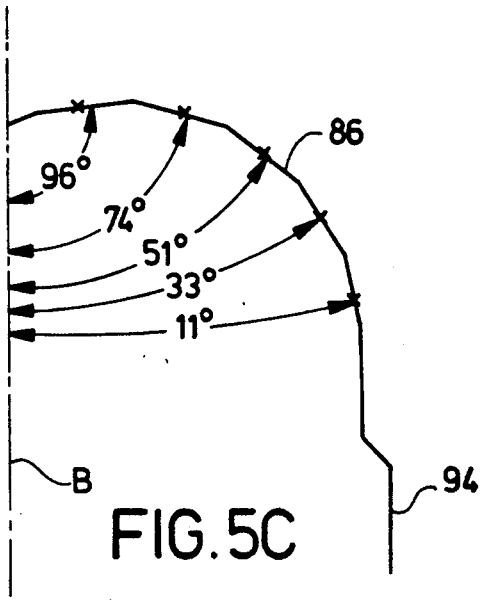
Figure 5D:
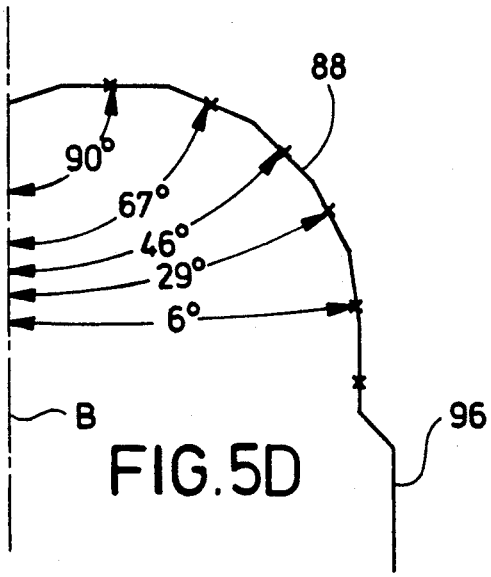

As shown in FIG. 3 of the drawings, an exemplary embodiment of a matrix body bit mold of the present invention is generally designated by the reference numeral 60 and shown to include a faceted inner surface 62 supporting a plurality of cores or plugs 64. Each of the cores 64 has planar end faces 66 one of which is attached, for example, by gluing, to a separate facet or flat 68 of the faceted inner mold surface 62. The mold 60 and cores 64 are made from a material such as graphite which can withstand the high furnace temperatures encountered during a conventional infiltration process. The mold 60 may either be a hard type mold of machined graphite or a soft type mold made by pressing a bit pattern (FIGS. 5A-5D) into a settable mud made up of, for example, clay, graphite, sand, plaster or other conventional materials. The faceted inner surface 62 of the mold 60 forms a faceted bit body profile such as one of the faceted wings 38 of the bit body 32 (FIG. 2). Each of the cores 64 forms an aperture or socket in the faceted profile of a matrix bit body such as the apertures 42 in the faceted wings 38 of the drag bit 30 (FIG. 2).

FIGS. 4A and 4B compare the attachment of a core or plug 70 having planar end faces 72 to a curved inner surface 74 of a conventional matrix body bit mold 76 with the attachment of one of the cores 64 having planar end faces 66 with one of the facets 68 of the mold 60 (FIG. 3). Since the planar end face 72 of the core 70 which is attached to the curved inner mold surface 74 by, for example, a conventional adhesive does not mate completely with the curved inner surface 74, there exists a gap 78 therebetween. This gap 78 not only allows matrix material to enter the gap and create an undesirable sprue or flash between the core 70 and mold 76 during an infiltration process, but also allows the core 70 to tilt or wobble relative to the mold 76 which makes it difficult to attach the core 70 to the mold 76 at the desired angle.

In contrast, the facets 68 of the mold 60 of the present invention provide a planar surface which matches exactly with the planar end face 66 of the core 64 (FIG. 4B). Since no gap exists between the core 64 and mold 60, no sprues or flashes of matrix material form therebetween and the core 64 is easily attached to the mold 60 at the desired location and orientation relative to the facet 68.

As shown in FIGS. 5A-5D of the drawings, an exemplary embodiment of a bit pattern of the present invention is generally designated 80 and shown to include four faceted blades 82, 84, 86 and 88 and four gage pads 90, 92, 94 and 96 for forming a mold for a blade profile matrix body bit having 0°, 90°, 180° and 270° faceted blades. The angles given in FIGS. 5A-5D are the angles between the planes of the individual facets of the wings 82, 84, 86 and 88 and the bit centerline or axis B. The PDC cutter location points are designated with an X. The mold forming bit pattern 80 of the present invention is machined from a suitable material such as steel, aluminum, wood or graphite.

Generally, a bit pattern having a faceted profile in accordance with the present invention can be constructed by modifying an existing conventional curved profile bit pattern to include the desired facets. More particularly, this can be accomplished by scribing a cutter location point on the conventional curved pattern surface, rotating the pattern to the angle of the desired flat surface or facet, centering over the scribed cutter location, replacing the scribing tool with a mill tool, touching off of the pattern surface to determine zero depth, and plunging the mill tool to about 0.095 of an inch and running it out in all directions. In such a process, it may be necessary to cut the inner flat surfaces or facets before the outer flat surfaces to prevent removal of location points prior to machining.

With reference again to FIGS. 2 and 3 of the drawings, the matrix body drag bit 30 of the present invention is made by forming the mold 60 having a faceted inner surface 62 by either machining graphite to form a hard mold or by first machining a bit pattern to have a faceted profile (FIGS. 5A-5D) and then pressing the pattern into a settable mud to form a soft mold, adhering the cores 64 to the inner surface 62 of the mold 60, placing a shaped mandrel or blank along the centerline of the bit in order to leave open the drilling fluid central passage 52 and ports 54, placing the head blank 34 in the mold 60 with the head blank 34 spaced from the inner surface 62 of the mold 60 and surrounding the fluid passage forming mandrel, filing the spaces in and around the head blank 34 with a powdered hard metal skeleton, infiltrating the hard powdered metal with an alloy binder to form the matrix body 32 on the head blank 34, removing the matrix body from the mold and removing all of the plugs 64 and the fluid passage mandrel from the matrix body 32, welding the top sub 36 to the head blank 34, inserting the nozzles 56 into the ports 54, and finally securing the PDC cutters 40 in the sockets 42 by brazing.

Thus, it will be appreciated that as a result of the present invention, a highly effective drag bit, mold, pattern and method is provided by which the principal object and others are completely fulfilled. It is contemplated and will be apparent to those skilled in the art from the foregoing description and accompanying drawing illustrations that variations and/or modifications of the disclosed embodiment may be made without departure from the invention. For example, although only a single PDC cutter is shown in each facet of the faceted wings of the drag bits 10 and 30, it is contemplated that a plurality of cutters may be located on a single facet (especially in the facets adjacent the gage). Accordingly, it is expressly intended that the foregoing description and accompanying drawings are illustrative of a preferred embodiment only, not limiting, and that the true spirit and scope of the present invention be determined by reference to the appended claims.

What is a claimed is:

1. In a drill bit having a plurality of cutting elements distributed over the profile of the bit, the improvement comprising:

a facet in the bit profile adjacent each of said cutting elements located in an otherwise curved area of the bit profile, and wherein a number of said cutting elements are mounted in raised wings in said bit profile and said wings are faceted.

2. The drill bit of claim 1, wherein said drill bit is a full bore matrix body drag bit.

3. In a drill bit having a body defining a cutting face with openings extending into said body for supporting a cutting element in each opening, the improvement comprising:

a plurality of facets in said body, each of said faces surrounding a corresponding opening for receiving a cutting element, wherein each of said facets is oriented perpendicular to the longitudinal axis of its corresponding opening, and wherein said facets and openings are located in raised cutter supporting wings in said bit body.

4. The drill bit of claim 3, wherein said drill bit is a full bore matrix body drag bit.

5. In a method of producing a matrix body bit including the steps of forming a pattern, placing the pattern in a setable mud, removing the pattern, hardening the mud to form a bit mold, attaching a plurality of cores to the mold surface to create openings in the resultant matrix bit body for mounting cutter elements, forming a matrix bit body in said mold using an infiltration process, and mounting cutter elements in the openings formed by said cores, the improvement comprising the step of:

forming a plurality of small flat surfaces in the exterior of said pattern with each of said flat surfaces corresponding to the location whereat at least one of said cores is to be attached to said mold.

6. The method of claim 5, wherein each of said small flat surfaces is perpendicular to the longitudinal axis of the corresponding core.

7. The method of claim 6, wherein said cutter elements are located in raised wings in said bit body and said small flat surfaces lead to the formation of facets in said wings.

8. A pattern formed in accordance with the method of claim 5.

9. A mold formed in accordance with the method of claim 5.

10. A matrix bit formed in accordance with the method of claim 5.

11. A method of forming a plurality of small surfaces in a bit pattern comprising the steps of:

scribing a cutter location point on the pattern surface,
rotating the pattern to the angle of the flat surface,
centering over the scribed cutter location,
replacing the scribing tool with a mill tool,
touching off of the pattern surface to determine zero depth, and
plunging the mill tool to about 0.095 of an inch and running it out in all directions.

12. The method of claim 11, wherein inner flat surfaces are cut before outer flat surfaces to prevent removal of location points prior to machining.

13. In a pattern for forming a mold for a matrix body bit having one or more raised wings for supporting a plurality of cutter elements, the improvement comprising:

a plurality of facets in said wings, each of said facets corresponding to the location of at least one of said cutter elements.

14. The pattern of claim 13, wherein said cutter elements are stud mounted and each of said facets is perpendicular to the longitudinal axis of the stud of the corresponding cutter element.

15. In a mold for forming a matrix body bit having one or more raised wings for supporting a plurality of cutter elements, the improvement comprising:

a plurality of flats in the wing forming surfaces, each of said flats corresponding to the location for attachment of at least one core.

16. The mold of claim 15, wherein each of said flats is at a common angle with respect to the longitudinal axis of its corresponding core.

17. In a method of producing a matrix body bit, the improvement comprising the step of:

using a bit pattern having faceted wings.

18. In a method of producing a matrix body bit, the improvement comprising the step of:

using a mold having flats for producing a bit body having faceted wings.

19. In a matrix body bit having one or more raised wings for supporting a plurality of cutter elements, the improvement comprising:

a plurality of facets in said wings, each of said facets corresponding to the location of at least one of said cutter elements.

20. The matrix body bit of claim 19, wherein said bit is a full bore drag bit and said cutter elements are stud mounted PDC cutters.

21. In a method of producing a matrix body bit including the steps of forming a bit mold, attaching a plurality of cores to the inner mold surface to create openings in the resultant matrix bit body for mounting cutter elements, forming a matrix bit body in said mold using an infiltration process, and mounting cutter elements in the openings formed by said cores, the improvement comprising the step of:

forming a plurality of small flat surfaces in the inner surface of said mold with each of said flat surfaces corresponding to the location whereat at least one of said cores is to be attached to said mold.

22. The method of claim 21, wherein each of said small flat surfaces is perpendicular to the longitudinal axis of the corresponding core.

23. The method of claim 21, wherein said cutter elements are located in raised wings in said bit body and said small flat surfaces lead to the formation of facets in said wings.

24. The method of claim 21, wherein said mold is a hard mold and said step of forming a plurality of flat surfaces includes machining said flat surfaces.

25. The method of claim 21, wherein said mold is a soft mold and said step of forming a plurality of flat surfaces includes using a pattern having corresponding flat surfaces to form said mold.

26. A mold formed in accordance with the method of claim 21.

27. A matrix body bit formed in accordance with the method of claim 21.

* * * * *